United States Patent [19]

Hodson

[11] 4,367,836

[45] Jan. 11, 1983

[54] NAIL DRIVER

[76] Inventor: Ivan E. Hodson, 99 Marlborough Ave., Toronto, Ontario, Canada, M5R 1X6

[21] Appl. No.: 174,763

[22] Filed: Aug. 4, 1980

[30] Foreign Application Priority Data

Aug. 24, 1979 [CA] Canada ..... 334528

[51] Int. Cl.[3] ..... B25C 1/02

[52] U.S. Cl. ..... 227/142; 227/147

[58] Field of Search ..... 227/142, 147

[56] References Cited

U.S. PATENT DOCUMENTS

| | | | |
|---|---|---|---|
| 329,278 | 10/1885 | Copeland | 227/147 |
| 452,519 | 5/1891 | Fernald | 227/147 |
| 875,658 | 12/1907 | Dutton | 227/147 |
| 913,014 | 2/1909 | Kafer | 227/147 |
| 1,808,452 | 6/1931 | Cousins | 227/147 |
| 2,285,384 | 6/1942 | Schott | 227/142 |
| 2,839,754 | 6/1958 | Pfaff | 227/147 |
| 2,855,601 | 10/1958 | Hamlin | 227/147 |
| 3,012,247 | 12/1961 | Sillars et al. | 227/147 |
| 3,147,484 | 9/1964 | Nelson | 227/147 |

*Primary Examiner*—John McQuade

*Attorney, Agent, or Firm*—Leon Arthurs; Kenneth M. Garrett

[57] ABSTRACT

A manual tool suitable for driving nails into concrete or the like comprises an axially extended tube and a ram mounted for reciprocal movement therein, the ram having a handle at one end thereof. The diameter of the ram along its length is substantially less than that of the bore of the tube. The end of the ram remote from the handle is provided with a low friction means to space the ram from the walls of the tube. Typically the low friction spacing means comprises a plurality of ball bearings located respectively in a plurality of recesses formed in the radial surface of the ram.

15 Claims, 3 Drawing Figures

NAIL DRIVER

FIELD OF THE INVENTION

This invention relates to a manual tool for driving nails or the like. It particularly relates to improvements whereby such tool may be used in conjunction with hardened nails to be driven into hard substrates such as concrete or metal.

BACKGROUND OF THE INVENTION

Nail drivers have long been known in the prior art. An early form thereof is shown in U.S. Pat. No. 913,014 issued Feb. 23, 1909 to Kafer; this comprises an axially extended tube, a ram mounted for reciprocal movement in the tube, a handle for the ram and a nail holder formed as a coaxial extension of the tube. Little problem has been experienced in the past when using such tool for stapling or nailing wood or similar material. However, it is not believed that there have been any successful commercial embodiments of this type of tool that are suitable for driving nails into hard substrates as is now desired.

Much of the commercial activity in this area has been concentrated on powder actuated tools. These may be of a a high velocity type or a low velocity type; both types have contributed to many industrial accidents. Manual nail drivers may not be mis-used in the same way as the powder actuated tools as the velocity, and hence the energy, of a nail which may be freely expelled from such tools is extremely low.

Part of the problem in relation to the use of manual tools for driving nails into hard substances resides in the limited impact forces that can be generated, particularly when operated under adverse conditions. It is generally found that when the impact force does not exceed what appears to be a critical minimum limit, spalling of the concrete takes place, and that even though completely set the nail is not retained with as much force as when it is set using adequate impact force.

There are several constraints in manufacturing a manual nail driving tool of the type referred to. Thus the tool must be of robust design so as to withstand the rough handling that it is likely to receive on a construction site. The tool must be priced so as to be competitive with other alternative nail setting tools. These factors do not permit a highly engineered tool considering the tool in more detail, the tube portion thereof may typically have a length of some 18–24 inches and an internal diameter of about 1 inch. The ram of the tool is similarly dimensioned and must be pushed the length of the tube in order to generate the maximum impact force. It will be appreciated that particularly under adverse conditions, such as when the nail driver is operated other than in a vertical position, there may be a relatively large area of a surface contact between the tube and ram, and that high frictional losses may ensue to reduce the available impact force. Also the end of the ram is normally equipped with a pin as an integral extension thereof, the pin entering the nail holder and contacting the nail to be driven. The nail holder normally has a bore opening therethrough only nominally greater than the diameter of the pin, and serves to concentre the pin so as to strike a nail held therein squarely. The impact force of the ram may also be partially expended by the pin striking the walls of the bore opening.

It is object of my invention to provide a manual nail driver suitable for use in driving nails into hard substrates.

It is a further object of my invention to provide in such nail driver improved structure so as to limit the above defects and maximize the impact forces, whilst at the same time providing an economic construction.

SUMMARY OF THE INVENTION

Briefly, a nail driver in accordance with my invention comprises the basic elements common to the aforementioned nail driver, viz. a tube, a ram mounted for reciprocal movement in the tube having a handle at one end thereof, and a nail holder formed as a coaxial extension of the tube. In such arrangement, I provide a substantial radial clearance, as will be further defined, between the bore of the tube and the ram. I further provide on the ram adjacent the end thereof remote from the handle, a low friction means for concentrically spacing that end of the ram in the tube. This low friction means comprises a plurality of small, discrete raised areas situated about the radial surface of the ram. Preferably, such small discrete raised areas will be rolling, and in accordance with the preferred embodiment they may be formed by surface portions of spherical balls disposed in recesses formed in the radial surface of the ram. Less desirably, although also comprehended my invention, the small, discrete raised areas may be static, and formed by low friction materials, amongst which may be exemplified plastic materials, for example PTFE and nylon. Still other means will occur to persons skilled in the art to which my invention pertains. My invention will now be further described with reference to the accompanying illustrated embodiment thereof, where

DESCRIPTION OF PREFERRED EMBODIMENT OF THE INVENTION

Figure 1:
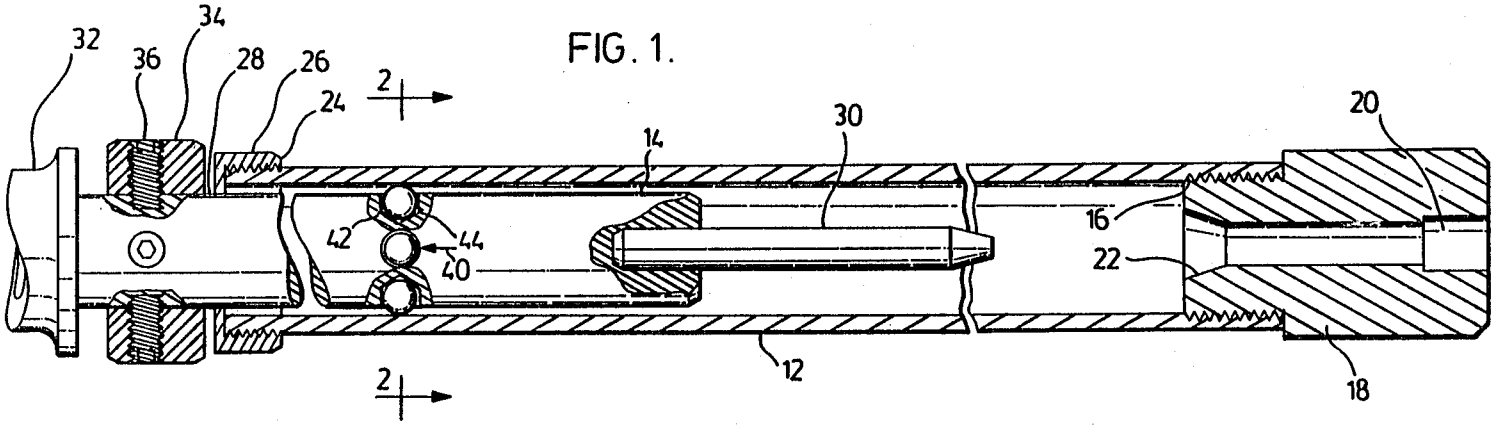
FIG. 1 is an elevational view partially in section and partially cut away of my nail driver.

In these Figures, the nail driver constructed in accordance with my invention is represented generally by the numeral 10, and will for brevity be referred to in the ensuring description simply as driver. Driver 10 comprises a right circular tube 12 and a ram 14. Tube 12 has preferably a smooth uniform bore along its length. Seamless mild steel tubing is adequate for this component although lighter alloys of adequate strength may be deemed preferable, particularly where it is desired to employ driver 10 in overhead situations. Ram 14 has a complementary cross section to that of the bore of tube 12, but the radial dimension of the ram along the length thereof which is to be received within tube 12 is less than that of the bore so as to provide a substantial clearance therebetween. By substantial clearance I mean a sufficient clearance to preclude contact between the bore of the tube 12 and the radial surface of ram 14 when the ram is concentred in the tube by the spacing means forming part of my invention, to be further described in relation to this embodiment. A minimum practical value for such radial clearance is about 10 mils (0.25 mm). Such value might be further reduced, as by where the surfaces of tube 12 and ram 14 are highly machined, for example, but this expedient is quite unnecessary and not in conformity with providing a relatively low cost tool. The clearance may be much higher, of course, but this would be inimical with optimizing the power to weight ratio.

One end of tube 12 is threaded internally at 16, and a nail holder 18 is threadably secured thereto. Nailholder 18 has a central opening 20 therethrough concentric with the bore of tube 12 and communicating therewith in a flared portion 22. The other end of tube 12 is externally threaded at 24, to which is threadably secured a cap 26 having a central opening 28 therethrough of diameter less than of the bore of tube 12 but marginally greater than the diameter of ram 14, so as to permit the ram to pass freely therethrough. Cap 26 is of limited longitudinal extent adjacent opening 28 so as to reduce the contact area between it and ram 14.

The end of ram 14 which extends within tube 12 is provided with a coaxial pin 30 which projects therefrom. The pin 30 has a longitudinal extent approximately equal to that of opening 20 in nail holder 18 and a diameter marginally less than that of opening 20. Pin 30 is unified with ram 14 by any convenient means such as press fitting, heat shrinking or by being threadably received therein. Desirably pin 30 is constructed of a hardened tool steel; ram 14 may suitably be mild steel.

The other end of ram 14 is provided with a handle, shown only in part and identified by the numeral 32, for transmitting a manual force to ram 14. Intermediate the ends of ram 14 and adjacent to the inwardly facing end of handle 32 there is secured to ram 14 a stop collar 34 using Allan screws 36 received in radial depressions formed in the surface of ram 14. The lower surface of stop collar 34 abuts the upper surface of cap 26 to control the penetration of ram 14 into tube 12.

Figure 2:
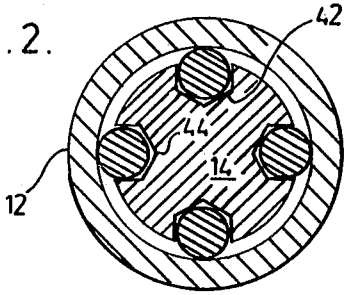
FIG. 2 is a sectional view along 2–2 of FIG. 1 on an enlarged scale.

It will be apparent that the driver 10 thus far described has several basic deficiencies which would limit its commercial use. Inparticular the frictional engagement between the ram 14 and the bore of tube 12 would, at least in adverse situations of use of the driver, be relatively high. Also, pin 30 would tend to strike the opening 20,22 of nail holder 18 when the ram 14 was driven forwardly, further reducing the force available to drive nails. Still further, ram 14 would be subject to total withdrawal from tube 12, creating a possible hazard particularly where it is desired to employ driver 10 in an inverted position. Driver 10 constructed in accordance with my invention further includes a low friction spacing means adjacent the end of ram 14 to which pin 30 is secured, such means being represented generally in FIGS. 1 and 2 by the numeral 40. The most simple form thereof comprises a plurality of generally opposed recesses 42 formed in radial surface of ram 14 into which are respectively fitted balls 44 which form small discrete, raised surface areas adjacent the end of ram 14. In plan form, the extreme outer surfaces of the balls lay on the circumference of a circle having a diameter only marginally less than that of the bore of tube 12. Generally the preferred radial clearance between the circle and the bore of tube 12 will be only 1–2 mils (0.025 to 0.05 mm), so as to minimize lateral displacement of ram 14. It will be appreciated that the actual value will be governed to some extent by the tolerance variation of the bore of tube 12, as the ram must slide freely within the tube.

In theory only two diametrically opposed recesses 42 and balls 44 would be sufficient to prevent lateral displacement of ram 14 in tube 12. In practice I prefer to space the recesses by 90° and so provide four balls. Other similar means are contemplated. Thus plugs of low friction polymer material such as nylon or P.T.F.E. could replace balls 44, or alternatively the balls could be retained in a ball cage fitted onto a smaller diameter portion of ram 14, for example.

Having thus described the nail driver 10 constructed in accordance with my invention, the use contemplated thereof will be explained. Generally when driving nails it is found to be desirable to limit the degree to which they are set. This is effectively limited by the axial penetration of pin 3 into the nailholder 18. In my driver 10 both the effective length of the ram 14 and that of the tube 12 may be easily varied to limit this penetration. Thus the stop collar 34 is secured to ram 14 by asymmetric securing means comprising the Allan screws 36 which locate in a radial plane offset from the longitudinal bisecting plane of stop collar 34; the stop collar may thus be secured to ram 14 in either of two positions providing different, predetermined limits of the penetration of ram 14 into tube 12 and thus the set of a nail being driven. Nail holder 18, being threadably secured to tube 12, provides a continuously variable means for adjusting the effective degree of penetration of ram 14 into tube 12, and thus constitutes a fine tuning nail setting control. Indicia means may be provided on adjacent surfaces of tube 12 and nail holder 18 to provide a visual indication of the control setting. It will be apparent that the low friction spacing means 40 in addition to providing the function earlier spoken of will further serve the purpose of precluding the accidental withdrawal of ram 14 from tube 12, the raised surface areas of the ram engaging the wall surrounding the opening 28 in cap 26 before the ram 14 is fully withdrawn from tube 12.

Figure 3:
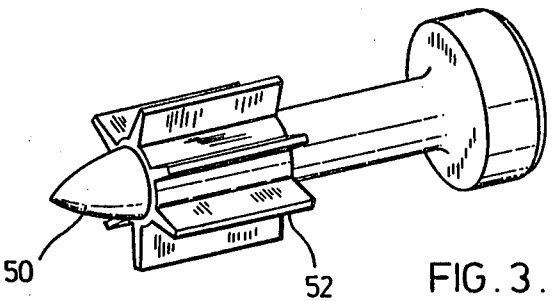
FIG. 3 is an isometric view of a nail and a bushing therefor such as may be used with the nail hammer.

Referring specifically to FIG. 3, a nail suitable for use with driver 10 is denoted therein by the numeral 50. Such nail 10 will typically have a shank having a substantial diameter, usually in the range of about 125 to 150 mils (3 to 4 mm). Nail 10 will suitably be of austempered steel hardened to about 50 Rockwell C. A radially finned bushing 52 of a crushable material such as a soft plastic surrounds the shank of nail 50 and functions to retain nail 50 centred in the opening 20 of nail holder 18. Typically the impact energy necessary to drive such nail 50 into concrete, assuming about 0.6 inches, (15 mm) of penetration, is 300 ft. lbs. (400 mN). When driven with a nail driver constructed in accordance with the illustrated embodiment and having a steel ram of 20 inches (50 cm) travel and 0.75 inches diameter, an impact energy of about 200 ft-lbs, (270 mN) can be generated to give a clean penetration of the nail with 2 or 3 blows when the driver is employed in the least favourable horizontal position. When such nail is similarly driven with comparable tools without the instant low friction means it is found that the degree of penetration per blow is generally less, and that spalling of the concrete often occurs.

I claim:

1. In a nail driver comprising an elongated tube, an elongated ram mounted for reciprocal movement in said tube, said ram having a first end and an opposite end thereto having a handle means therefor, the improvement wherein the radial dimension of said ram is substantially less than that of the tube, so as to provide a substantial clearance between the radial wall of said ram along the length thereof and the interior wall of said tube, and wherein low friction spacing means is provided adjacent said first end of said ram, said low friction spacing means being dimensioned and located so as to substantially preclude lateral displacement of said first end of said ram with respect to said tube and comprising a plurality of rolling surfaces.

2. The nail driver of claim 1, wherein said rolling surfaces are balls.

3. The nail driver of claim 2 wherein said balls are disposed in recesses formed in the radial surface of said ram.

4. The nail driver of claim 3, wherein said tube is provided with a cap adjacent said handle means, said cap having an opening therein for the passage of said ram therethrough, the opening having a diameter intermediate that of said ram and that of the internal wall of said tube.

5. The nail driver of claim 3 wherein said ram is provided with a stop collar adjacent said opposite end intermediate said handle means and said first end.

6. The nail driver of claim 3 wherein said tube is provided with a nail holder at the end thereof adjacent the first end of said ram, and wherein said nail holder is threadably secured to said tube.

7. The nail driver of claim 1, wherein said ram is provided with a stop collar adjacent said handle means, and wherein said stop collar is provided with asymmetric securing means for securing said stop collar to said ram whereby the travel of said ram into said tube may be limited and varied in a predetermined manner.

8. The nail driver of claim 1, wherein both continuously variable and preset means are provided for controlling the degree to which a nail may be set therewith.

9. The nail driver of claim 1, including a pin integrally secured to the first end of said ram and coxial therewith.

10. A nail driver comprising a longitudinally extended tube, a longitudinally extended ram mounted in said tube for reciprocal movement therein, said ram having a radial dimension so as to provide a substantial clearance between the radial surface therof and the bore of said tube, said ram having a first end and a second end, a handle means attached to said second end, a plurality of small discrete raised areas disposed about said first end of said ram on the radial surface thereof, said small discrete raised areas in planform having their extreme outer surfaces locating on a locus having a radial dimension only marginally less than that of the bore of said tube, so as to coaxially align the first end of said ram and said tube.

11. The nail driver of claim 10 wherein said tube and said ram have right circular radial cross section.

12. The nail driver of claim 10 wherein said small discrete raised areas are rolling.

13. The nail driver of claim 12 wherein the rolling areas comprise balls.

14. The nail driver of claim 13 wherein said balls are disposed in recesses formed in the radial surface of said ram.

15. The nail driver of claim 14 further comprising a nail holder coxially secured to said tube and a pin engageable with said nail holder integrally secured to the first end of said ram as a coaxial extension thereof.

* * * * *